US007575096B2

(12) United States Patent
Arbuckle et al.

(10) Patent No.: US 7,575,096 B2
(45) Date of Patent: Aug. 18, 2009

(54) PRESSED ASSEMBLY FOR PASSIVE VALVE INSTALLATION

(75) Inventors: Ivan Arbuckle, Columbus, IN (US); Robin Willats, Columbus, IN (US); Joseph E. Callahan, Greenwood, IN (US); Anthony Morales, Columbus, IN (US)

(73) Assignee: EMCON Technologies LLC, Wilmington, DE (US)

( * ) Notice: Subject to any disclaimer, the term of this patent is extended or adjusted under 35 U.S.C. 154(b) by 345 days.

(21) Appl. No.: 11/231,556

(22) Filed: Sep. 21, 2005

(65) Prior Publication Data

US 2007/0062757 A1 Mar. 22, 2007

(51) Int. Cl.
*F01N 1/02* (2006.01)

(52) U.S. Cl. ..... 181/253; 181/227; 181/228; 181/250; 181/254; 181/266; 181/273; 181/276

(58) Field of Classification Search ..... 181/227, 181/228, 250, 266, 273, 276, 253, 254
See application file for complete search history.

(56) References Cited

U.S. PATENT DOCUMENTS

| | | | | | |
|---|---|---|---|---|---|
| 2,656,005 | A | * | 10/1953 | Cary | 181/266 |
| 3,434,565 | A | * | 3/1969 | Fischer | 181/250 |
| 4,239,091 | A | * | 12/1980 | Negrao | 181/243 |
| 4,484,659 | A | * | 11/1984 | Buchwalder | 181/266 |
| 4,700,806 | A | * | 10/1987 | Harwood | 181/282 |
| 4,836,330 | A | * | 6/1989 | Harwood et al. | 181/282 |
| 4,892,168 | A | * | 1/1990 | Sasaki et al. | 181/250 |
| 4,909,348 | A | * | 3/1990 | Harwood et al. | 181/282 |
| 4,971,166 | A | * | 11/1990 | Hase | 181/254 |
| 5,173,576 | A | * | 12/1992 | Feuling | 181/247 |
| 5,280,143 | A | * | 1/1994 | Kakuta | 181/250 |
| 5,563,385 | A | * | 10/1996 | Harwood | 181/282 |
| 5,614,699 | A | * | 3/1997 | Yashiro et al. | 181/254 |

(Continued)

FOREIGN PATENT DOCUMENTS

JP 2002070526 3/2002

OTHER PUBLICATIONS

International Preliminary Report On Patentability Dated Apr. 3, 2008.

*Primary Examiner*—Jeffrey Donels
*Assistant Examiner*—Jeremy Luks
(74) *Attorney, Agent, or Firm*—Carlson Gaskey & Olds, P.C.

(57) ABSTRACT

A muffler assembly includes first and second muffler components that are each formed as a single piece. The first muffler component includes a first outlet pipe portion, a first bypass pipe mount portion, and a first resonator shell portion. The second muffler component includes a second output pipe portion, a second bypass pipe mount portion, and a second resonator shell portion. The first and second muffler components are positioned in an overlapping relationship such that respective portions are aligned with each other to form an outlet pipe, a bypass pipe mount, and a resonator shell. A noise attenuation valve assembly is also installed within the first and second muffler components. The bypass pipe mount is positioned at a non-perpendicular orientation relative to the outlet pipe such that a bypass pipe having a straight end mount can be received within the bypass pipe mount to bypass the noise attenuation valve assembly.

25 Claims, 5 Drawing Sheets

U.S. PATENT DOCUMENTS 5,708,237 A * 1/1998 Maeda et al. ..... 181/254
5,984,045 A * 11/1999 Maeda et al. ..... 181/254
6,053,276 A * 4/2000 D'Amico et al. ..... 181/243
6,173,808 B1 * 1/2001 Maeda et al. ..... 181/254
6,178,745 B1 * 1/2001 Meusen ..... 60/312
6,189,650 B1 * 2/2001 Inuzuka et al. ..... 181/254
6,257,367 B1 * 7/2001 Allman ..... 181/282
6,341,664 B1 * 1/2002 Gerber ..... 181/282
6,397,586 B1 * 6/2002 Sakurai et al. ..... 60/288
6,415,889 B1 * 7/2002 Wyatt ..... 181/282
6,633,646 B1 * 10/2003 Hwang ..... 381/71.5
6,659,222 B1 * 12/2003 Allman ..... 181/282
2004/0026165 A1 * 2/2004 Takahashi et al. ..... 181/253

* cited by examiner 10
12
16
20
22
24
26
40
42
44
48
58
60
62
70
72
74
76
78
80

PRESSED ASSEMBLY FOR PASSIVE VALVE INSTALLATION

TECHNICAL FIELD

The subject invention relates to a muffler assembly and a method for assembling a muffler that utilizes first and second muffler components that are each made as a single piece and attached to each other to form an outlet pipe, a bypass pipe mount, and a resonator shell.

BACKGROUND OF THE INVENTION

Vehicle exhaust systems include various exhaust components that direct exhaust gases from a vehicle engine to an outlet pipe. One such component is a muffler. The muffler includes a noise attenuation valve assembly to reduce noise generated during vehicle operation. A typical muffler configuration includes an inlet pipe, an outlet pipe, and a bypass pipe. The noise attenuation valve assembly is mounted within the outlet pipe and the bypass pipe provides a bypass path for exhaust gases when the noise attenuation valve assembly is closed. Additionally, the muffler includes a resonator associated with the outlet pipe that is used to attenuate high frequency noise.

This traditional muffler outlet pipe configuration presents many assembly and manufacturing challenges. The outlet pipe includes a first tube that is formed to receive the noise attenuation valve assembly and a second tube to which a resonator shell is joined. Resonator material is wrapped around the outer circumference of the second tube and the resonator shell is then joined to the second tube such that the resonator material is positioned between the resonator shell and the second tube. The first and second tube are appropriately sized such that the first and second tubes can be joined together to form the outlet pipe. Thus, the outlet pipe must be made from multiple tubes and is subjected to many sizing and joining operations, which is disadvantageous from a material and assembly cost perspective.

The first tube also includes a mount portion to receive the bypass pipe. This mount portion is positioned perpendicularly to the first tube. The bypass pipe includes a curved end mount that is received within the mount portion of the first tube. This complicates the formation of the bypass pipe. Further, a perpendicular entry angle between the outlet pipe and bypass pipe results in high levels of flow noise generation. Thus, the traditional bypass pipe configuration is also disadvantageous from a cost and noise generation perspective.

Thus, it is desirable to provide a muffler and method for assembling a muffler that uses fewer components while also providing improved noise reduction capability.

SUMMARY OF THE INVENTION

The subject invention provides muffler that includes first and second muffler components that are each formed as a single piece. The first and second muffler components are attached to each other to from a muffler sub-assembly that is mounted within a cavity defined by a muffler outer shell. The first and second muffler components are attached to each other to form an outlet pipe, a bypass pipe mount, and a resonator shell.

In one example configuration, the first muffler component includes a first outlet pipe portion, a first bypass pipe mount portion, and a first resonator shell portion. The second muffler component includes a second output pipe portion, a second bypass pipe mount portion, and a second resonator shell portion. The first and second muffler components are positioned in an overlapping relationship such that the first and second outlet pipe portions are aligned with each other to form the outlet pipe. The first and second bypass pipe mount portions are aligned with each other to form the bypass pipe mount adapted to receive a bypass pipe. The first and second resonator shell portions are aligned with each other to form the resonator shell adapted to receive a resonator.

Preferably, the first and second muffler components are utilized in a stamped muffler, however, the first and second muffler components could also be used in a lockseam muffler. In a stamped muffler configuration, the first muffler component is formed from a stamped horizontal baffle that is supported by the muffler outer shell. The second muffler component is also a stamped component that is attached to the stamped horizontal baffle.

The muffler also includes a noise attenuation valve assembly that can be installed within various locations. In one example, the noise attenuation valve assembly is installed within the stamped horizontal baffle, with an inlet pipe being positioned on one side of the stamped horizontal baffle and the outlet pipe being positioned on an opposite side of the stamped horizontal baffle. Optionally, the noise attenuation valve assembly could be installed within the outlet pipe, the bypass pipe, or within another, secondary, outlet pipe.

The first and second bypass pipe mount portions are each formed at a corresponding non-perpendicular orientation relative to the first and second outlet pipe portions. This allows the bypass pipe to have a generally straight end mount portion that is received within the bypass pipe mount formed by the first and second bypass pipe mount portions. This configuration eliminates a perpendicular entry angle for the bypass pipe resulting in improved noise reduction.

These and other features of the present invention can be best understood from the following specification and drawings, the following of which is a brief description.

DETAILED DESCRIPTION OF THE PREFERRED EMBODIMENT

Figure 1:
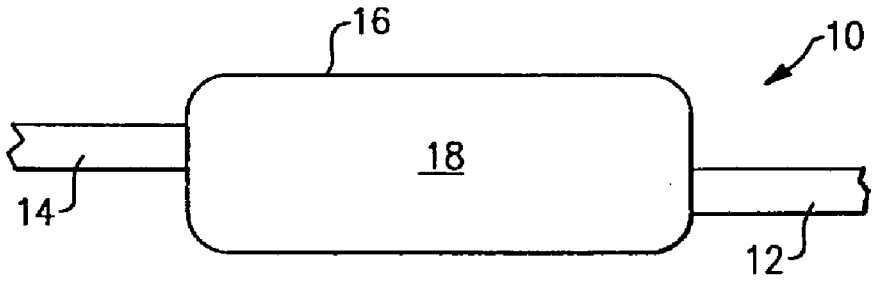
FIG. 1 is a schematic view of a muffler incorporating the subject invention.

A muffler 10 for a vehicle exhaust system is shown in FIG. 1. An inlet pipe 12 conducts exhaust gases from a vehicle engine (not show) into the muffler 10. The muffler 10 includes a tailpipe or outlet pipe 14 that conducts the exhaust gases from inside the muffler 10 to an external environment. The inlet pipe 12 and the outlet pipe 14 extend outwardly from a muffler outer shell 16. The muffler 10 is configured to attenuate noise generated within the vehicle exhaust system during vehicle operation.

Figure 2A:
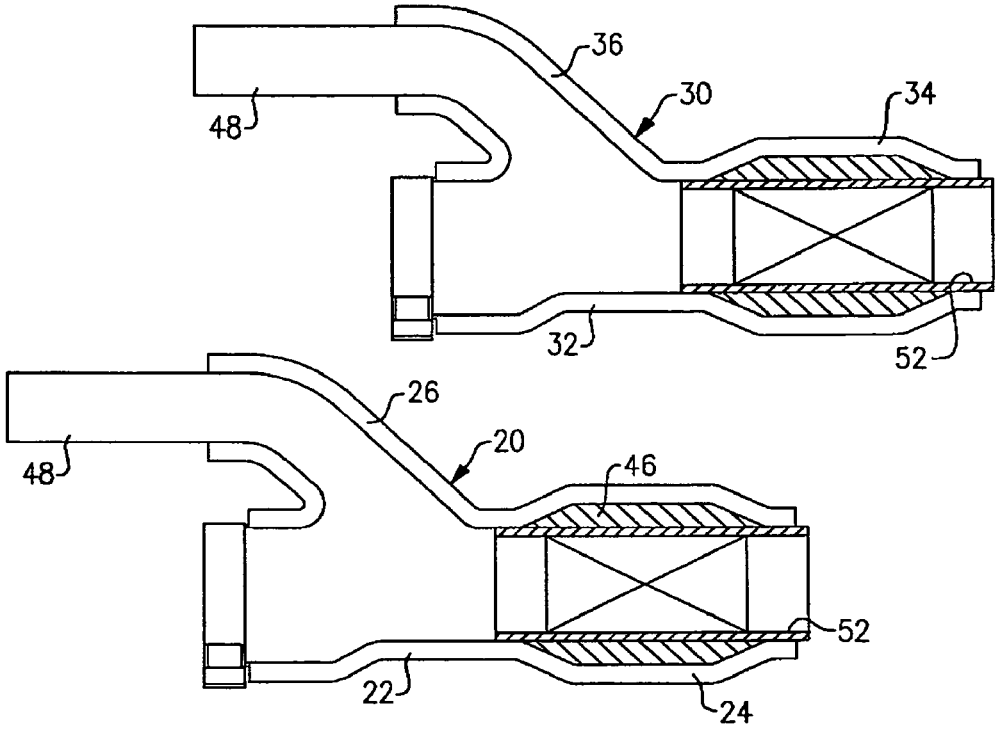
FIG. 2A is a schematic view of first and second single piece muffler components each including an outlet pipe portion, bypass pipe mount portion, and resonator shell portion according to the subject invention.

The muffler outer shell 16 defines an inner cavity 18 within which various muffler components are positioned. A first muffler component 20, shown in FIG. 2A, includes a first outlet pipe portion 22, a first resonator shell portion 24, and a first bypass pipe mount portion 26. A second muffler component 30 includes a second outlet pipe portion 32, a second resonator shell portion 34, and a second bypass pipe mount portion 36.

The first 20 and second 30 muffler components are each formed as a single half-shell piece that includes portions of different muffler components. The first 20 and second 30 muffler components can be formed as a single piece by pressing, stamping, etc. The first muffler component 20 is formed to provide a continuous, unbroken surface that extends between the first outlet pipe portion 22, first resonator shell portion 24, and first bypass pipe mount portion 26. The second muffler component 30 is formed to provide a continuous, unbroken surface that extends between the second outlet pipe portion 32, second resonator shell portion 34, and second bypass pipe mount portion 36.

Figure 2B:
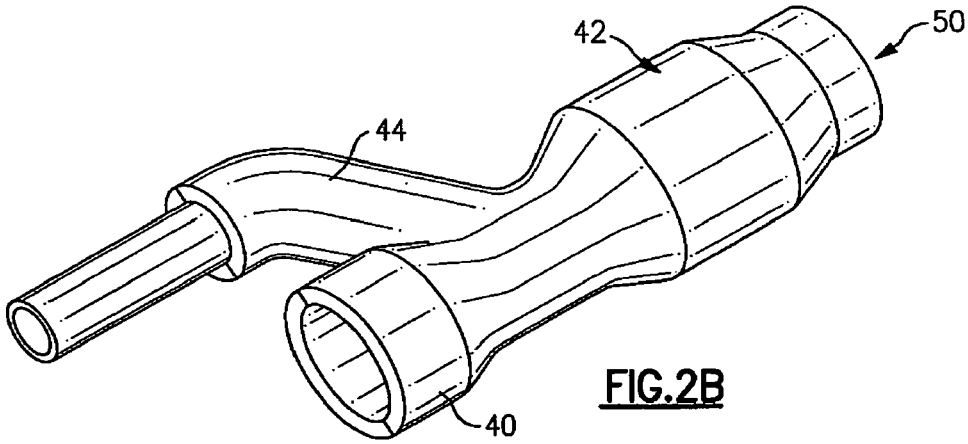
FIG. 2B is a perspective view showing the first and second single piece muffler components assembled together.

The first 20 and second 30 muffler components are positioned in an overlapping relationship with each other, as shown in FIG. 2B, such that the first 22 and second 32 outlet pipe portions are aligned with each other to form an outlet pipe 40. The first 24 and second 34 resonator shell portions are aligned with each other to form a resonator shell 42. The first 26 and second 36 bypass pipe mount portions are aligned with each other to form a bypass pipe mount 44. The resonator shell 42 includes a resonator material 46 (FIG. 2A) that is positioned between an outer circumference of the outlet pipe 40 and an inner circumference of the resonator shell 42. Any type of resonator material 46 can be used including e-glass, for example. The bypass pipe mount 44 receives a bypass pipe 48. This will be discussed in greater detail below.

Once aligned with each other, the first 20 and second 30 muffler components are attached or joined together to form a muffler sub-assembly 50 (FIG. 2B). Any type of attachment or joining process can be used including welding, for example. The muffler sub-assembly 50 is then installed within the inner cavity 18 of the muffler outer shell 16 (FIG. 1).

The first 20 and second 30 muffler components are thus formed as half pressings or stampings that are attached to each other such that only two (2) components are required to form the outlet pipe 40, resonator shell 42, and bypass pipe mount 44. These two components, which together form the muffler sub-assembly 50 can then be easily installed within the muffler outer shell 16. The muffler sub-assembly 50 can be used in any type of muffler 10, including lockseam and stamped mufflers for example. In one example configuration, the muffler sub-assembly 50 is assembled as follows.

The resonator material 46 is wrapped around a pipe portion 52 that is in fluid communication with one end of the resonator shell 42 to form a resonator sub-assembly. The resonator sub-assembly is then dropped into one of the first 20 and second 30 muffler components. The other of the first 20 and second 30 muffler components is then placed over the one of the first 20 and second 30 muffler components to enclose the resonator sub-assembly between the first 20 and second 30 muffler components and form a complete resonator. The pipe portion 52 preferably includes a plurality of perforations 58 as shown in FIG. 3.

The muffler 10 also includes a noise attenuation valve assembly 60 that can be installed within various locations to attenuate noise as known. Any type of noise attenuation valve assembly 60 can be used including vacuum and solenoid actuated valve assemblies, for example.

Figures 3, 5, 6:
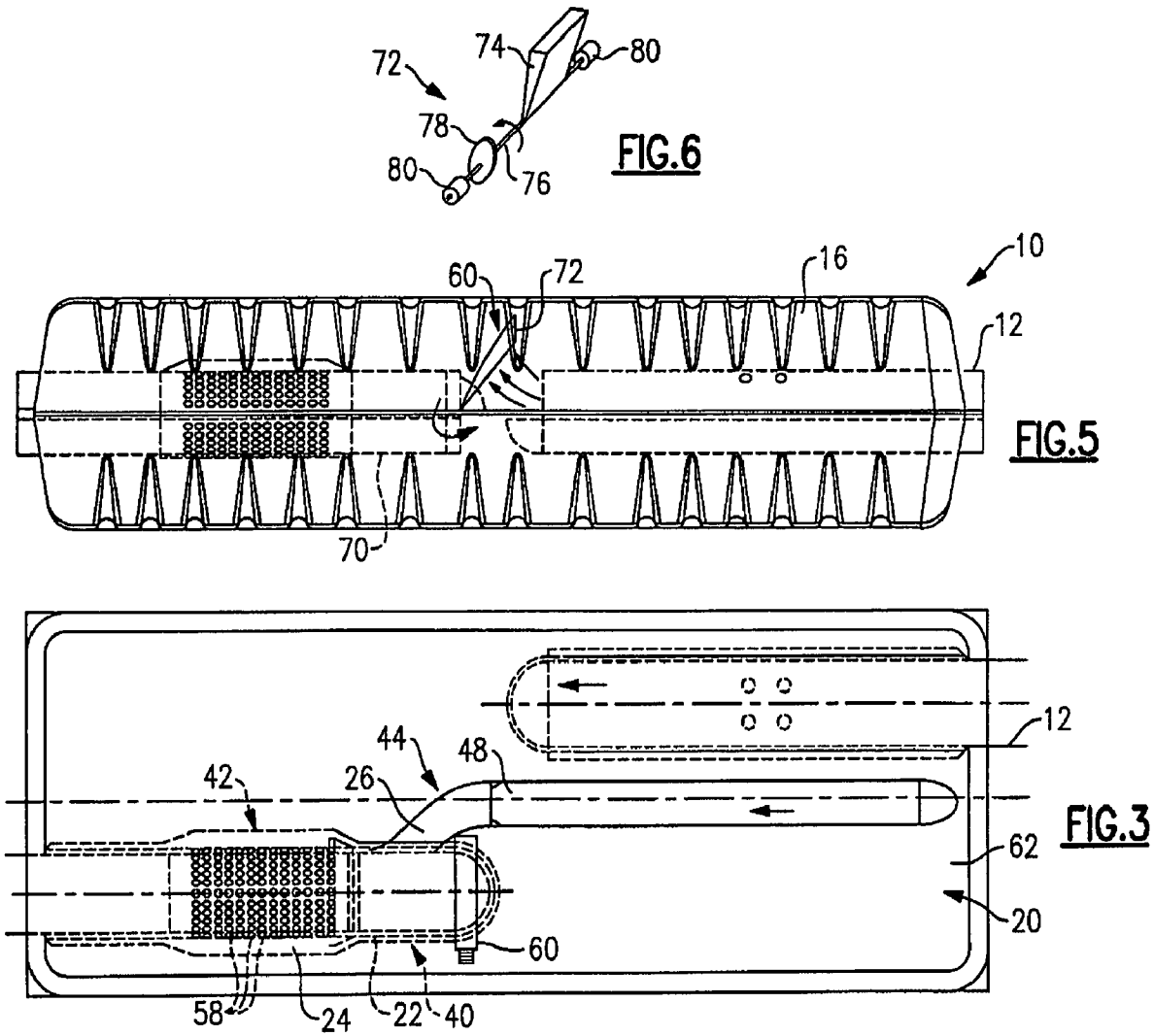
FIG. 3 is a schematic top view of one example noise attenuation valve configuration.
FIG. 5 is a schematic side view of another example noise attenuation valve configuration.
FIG. 6 is a schematic perspective view of a noise attenuation valve assembly as used in the configuration of FIG. 5.

In one example configuration shown in FIG. 3, the noise attenuation valve assembly 60 is used in a stamped muffler 10 that includes a horizontal baffle 62. In this configuration, one of the first 20 and second 30 muffler components is stamped into the horizontal baffle 62. The other of the first 20 and second 30 muffler components is formed from a stamped component 66 (FIG. 4B) that is then attached to the horizontal baffle 62. In the example shown in FIG. 3, the first muffler component 20 is stamped within the horizontal baffle 62, such that the horizontal baffle includes the first outlet pipe portion 22, first resonator shell portion 24, and first bypass pipe mount portion 26. The second muffler component 30 is separately stamped and is then attached to the horizontal baffle 62 to form the outlet pipe 40, resonator shell 42, and bypass pipe mount 44. The second muffler component 30 is not shown in FIG. 3 for clarity, however, the second muffler component 30 in this example would be similar to that shown in FIG. 4B.

In this example, the noise attenuation valve assembly 60 is positioned within the outlet pipe 40. The inlet pipe 12 is positioned on one side of the horizontal baffle 62 and the outlet pipe 40 is positioned an opposite side of the horizontal baffle 62.

Figure 4A:
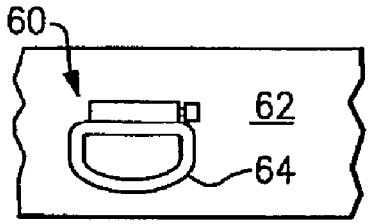
FIG. 4A is a schematic top view of another example noise attenuation valve configuration.
Figure 4B:
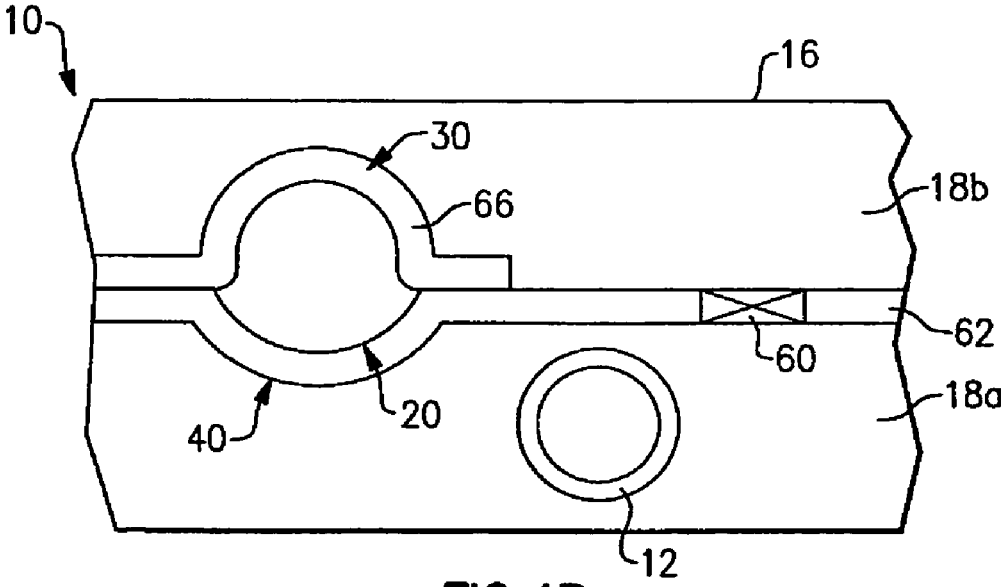
FIG. 4B is a schematic end view of the noise attenuation valve configuration shown in FIG. 4A.

In an alternate configuration, the noise attenuation valve assembly 60 is placed within the horizontal baffle 62 itself as shown in FIGS. 4A and 4B. The horizontal baffle 62 includes an opening 64 that receives the noise attenuation valve assembly 60. As shown in FIG. 4B, the horizontal baffle 62 separates the inner cavity 18 of the muffler outer shell 16 into a first cavity 18*a* on one side of the horizontal baffle 62 and a second cavity 18*b* on an opposite side of the horizontal baffle 62. The first muffler component 20 is stamped into the horizontal baffle 62 similar to that as shown in FIG. 3, and a stamped component 66 forms the second muffler component 30, which is attached to the horizontal baffle 62.

The inlet pipe 12 is positioned within one of the first 18*a* and second 18*b* cavities, and the outlet pipe 40 formed by the first 20 and second 30 muffler components is positioned within the other of the first 18*a* and second 18*b* cavities. Exhaust gas flows from the inlet pipe 12, through the noise attenuation valve assembly 60 in the horizontal baffle 62, and into the outlet pipe 40.

In an alternate configuration shown in FIG. 5, the noise attenuation valve assembly 60 is placed within a second outlet pipe or tailpipe 70. In this configuration the noise attenuation valve assembly 60 comprises a butterfly valve assembly 72 as shown in FIG. 6. The butterfly valve assembly 72 includes a vane body 74 supported on one edge by a shaft 76 that acts as a flow diverter. The shaft 76 supports a valve body 78, and is rotatably supported by bushings 80. The valve body 78 is positioned within the second tailpipe 70. Torsion springs (not shown) hold the butterfly valve assembly 72 in a closed position. Exhaust gas flow from the inlet pipe 12 onto the vane body 74 causes the valve body 78 to open.

Figure 7:
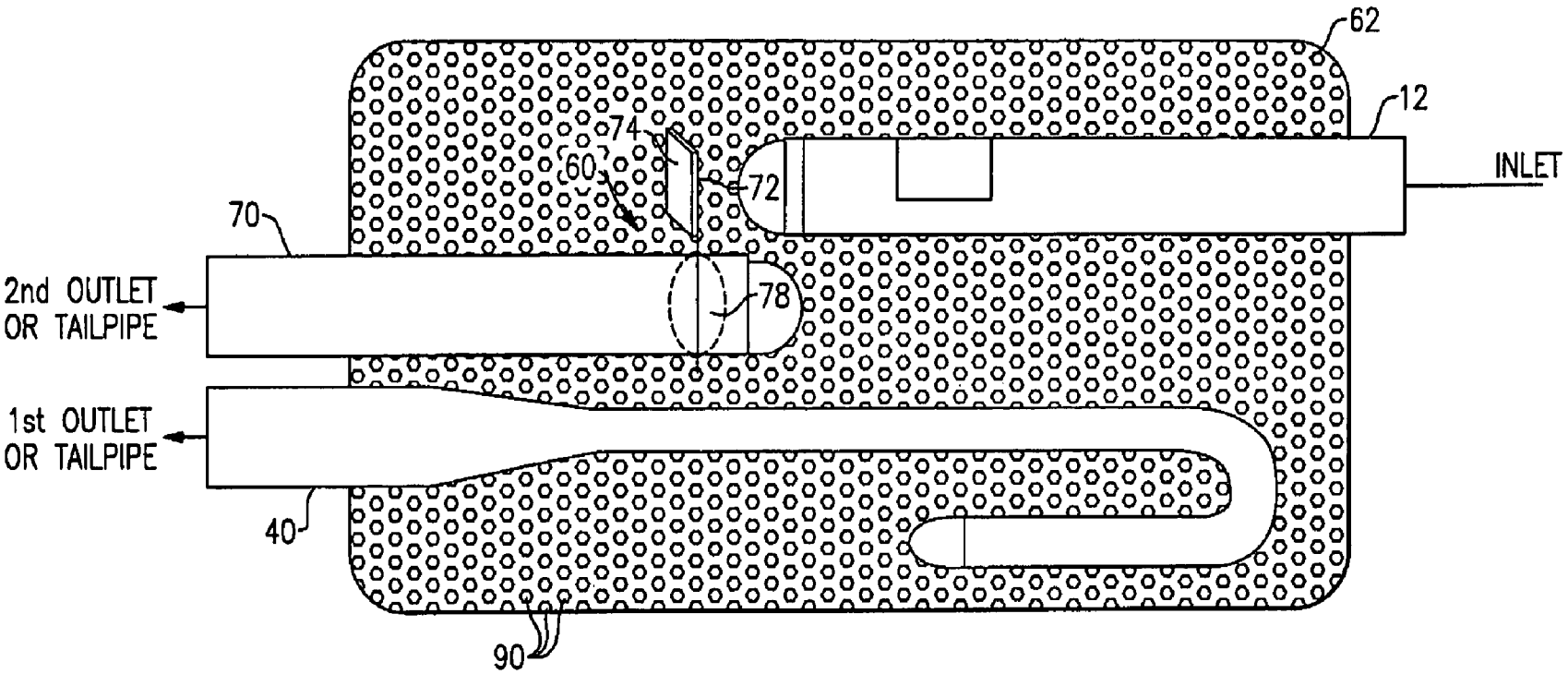
FIG. 7 is schematic top view of another example noise attenuation valve configuration.
Figure 8:
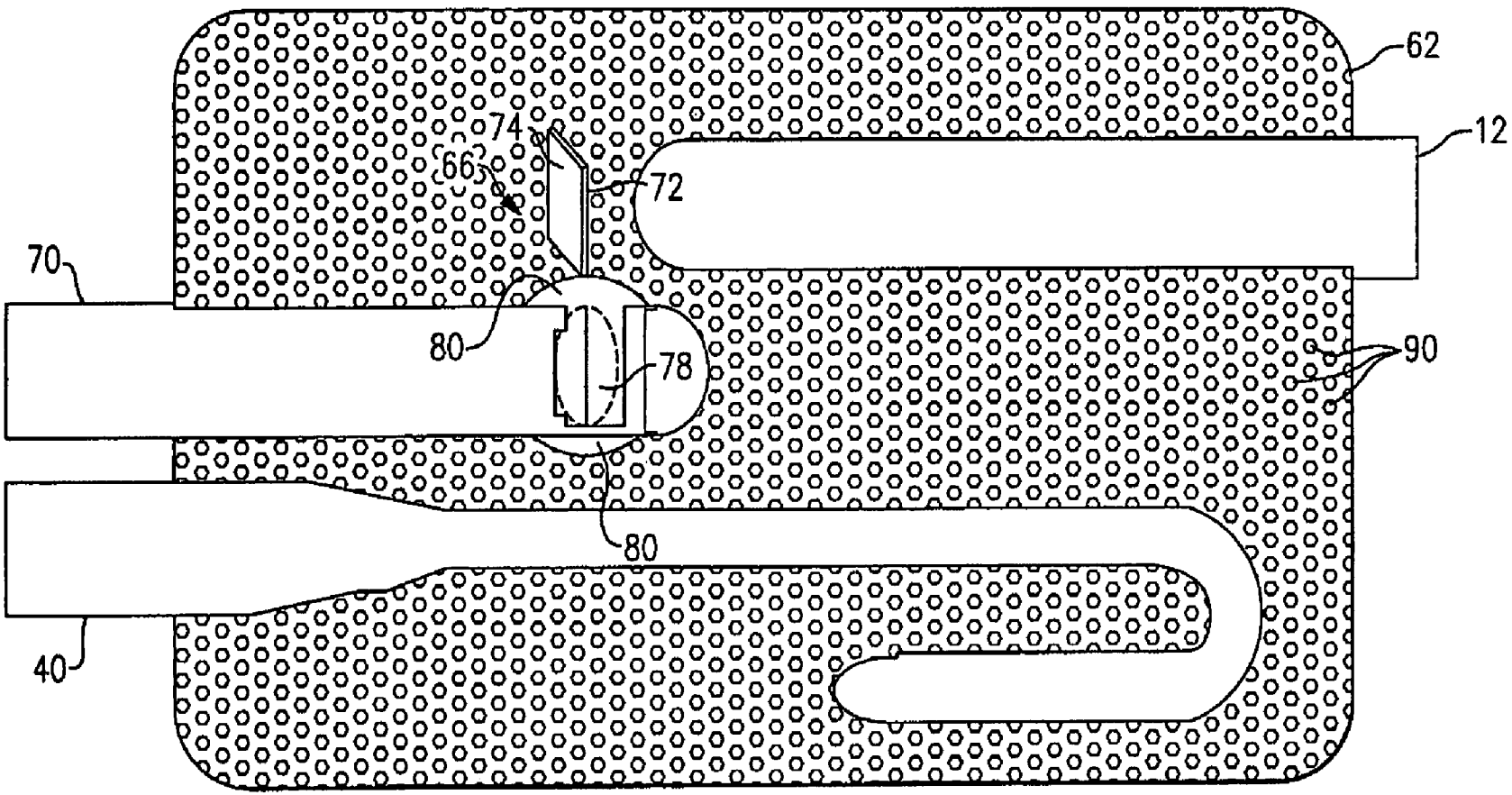
FIG. 8 is another example similar to the configuration of FIG. 7.

One example configuration of the butterfly valve assembly 72 being mounted within the second tailpipe 70 is shown in FIGS. 7 and 8. The horizontal baffle 62 includes lower half tube portions for the inlet pipe 12 and the outlet pipe 40, which forms a first tailpipe, and the second tailpipe 70. The second tailpipe 70 is spaced apart and separate from the inlet pipe 12 and first tailpipe. The first tailpipe is always open and provides a long tailpipe section with a small diameter to provide good low frequency attenuation. The first tail pipe may include several bend portions to further increase the length.

The butterfly valve assembly 72 is supported by the second tailpipe 70 as shown and is flow actuated by the vane body 74. Optionally, the butterfly valve assembly 72 could be pressure flap actuated without using a vane body. Also, as shown in FIG. 8, the bushings 80 could be trapped between stamped portions 82 formed on the second tailpipe 70. This reduces the components for the butterfly valve assembly 72.

Figure 9:
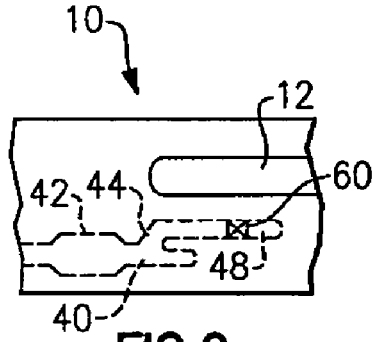
FIG. 9 is schematic top view of another example noise attenuation valve configuration.

In an alternate configuration shown in FIG. 9, the noise attenuation valve assembly 60 is placed within the bypass pipe 48. In any of these various configurations, the horizontal baffle can include perforations 90 as shown in FIGS. 7 and 8 or may not include any perforations as shown in FIG. 3. Further, the inlet tube and outlet tubes and/or tailpipes may also include perforations depending on desired muffler characteristics for different applications.

Although a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. A muffler assembly comprising:

a first muffler component having a first outlet pipe portion, a first bypass pipe mount portion, and a first resonator shell portion, said first muffler component being formed as a single piece; and a second muffler component having a second output pipe portion, a second bypass pipe mount portion, and a second resonator shell portion, said second muffler component being formed as a single piece, wherein said first and second muffler components are positioned in an overlapping relationship such that said first and second outlet pipe portions are aligned with each other to form an outlet pipe, said first and second bypass pipe mount portions are aligned with each other to form a bypass pipe mount adapted to receive a bypass pipe, and said first and second resonator shell portions are aligned with each other to form a resonator shell that receives a resonator in an internal cavity defined between said first and said second resonator shell portions.

2. The muffler assembly according to claim 1 including a muffler outer shell wherein said first and second muffler components are fixed together to form a muffler sub-assembly that is mounted within said muffler outer shell.

3. The muffler assembly according to claim 2 wherein said first muffler component comprises a stamped horizontal baffle that is supported by said muffler outer shell and said second muffler component comprises a stamped component that is attached to said stamped horizontal baffle.

4. The muffler assembly according to claim 3 including a noise attenuation valve assembly supported by at least one of said first and second muffler components.

5. The muffler assembly according to claim 4 wherein said noise attenuation valve assembly is positioned within said outlet pipe.

6. The muffler assembly according to claim 4 wherein said noise attenuation valve assembly is positioned directly within said stamped horizontal baffle separate from said outlet pipe and said bypass pipe with said outlet pipe being positioned on one side of said stamped horizontal baffle and an inlet pipe being positioned on an opposite side of said stamped horizontal baffle from said outlet pipe.

7. The muffler assembly according to claim 4 wherein said noise attenuation valve assembly is positioned within said bypass pipe.

8. The muffler assembly according to claim 4 wherein said outlet pipe comprises a first tailpipe extending outwardly from said muffler outer shell and a second tailpipe extending outwardly from said muffler outer shell, said first tailpipe being associated with said bypass pipe and said second tailpipe separate from said first tailpipe and wherein said noise attenuation valve assembly is positioned within said second tailpipe.

9. The muffler assembly according to claim 1 wherein said bypass pipe mount is non-perpendicular to said outlet pipe and wherein said resonator shell is axially aligned with said outlet pipe.

10. The muffler assembly according to claim 9 wherein said bypass pipe includes a generally straight end mount portion that is received within said bypass pipe mount such that said generally straight end mount portion is generally parallel to said outlet pipe.

11. The muffler assembly according to claim 1 wherein said bypass pipe mount comprises a first portion that extends obliquely relative to a centerline of the outlet pipe and a second portion that extends parallel relative to the centerline of the outlet pipe, with the bypass pipe to be received within said second portion.

12. The muffler assembly according to claim 1 wherein said resonator comprises a resonator material wrapped around a resonator pipe.

13. The muffler assembly according to claim 1 wherein said resonator and said outlet pipe are coaxial.

14. The muffler assembly according to claim 1 wherein said internal cavity is defined by inwardly facing surfaces of said first and said second muffler components, and including resonator material that is positioned within said resonator shell such that said resonator material is in abutting contact with said inwardly facing surfaces.

15. A method of forming a muffler assembly comprising:

(a) forming a first muffler component as a single piece, the first muffler component having a first outlet pipe portion, a first bypass pipe mount portion, and a first resonator shell portion;

(b) forming a second muffler component as a single piece, the second muffler component having a second output pipe portion, a second bypass pipe mount portion, and a second resonator shell portion; and (c) overlapping the first and second muffler components relative to each other such that the first and second outlet pipe portions are aligned with each other to form an outlet pipe, the first and second bypass pipe mount portions are aligned with each other to form a bypass pipe mount adapted to receive a bypass pipe, and the first and second resonator shell portions are aligned with each other to form a resonator shell that receives a resonator within an internal cavity defined between said first and said second resonator shell portions.

16. The method according to claim 15 including the steps of attaching the first and second muffler components together to form a muffler sub-assembly and mounting the muffler sub-assembly into a muffler outer shell.

17. The method according to claim 16 wherein the outlet pipe comprises a first outlet pipe positioned in fluid communication with one end of the resonator and including the steps of wrapping a resonator material around a second outlet pipe to form a resonator sub-assembly wherein the second outlet pipe is in fluid communication with an opposite end of the resonator, placing the resonator sub-assembly in one of the first and second muffler components, subsequently placing the other of the first and second muffler components over the one of the first and second muffler components, and subsequently attaching the first and second muffler components together to form the muffler sub-assembly.

18. The method according to claim 16 including the steps of forming the bypass pipe mount at a non-perpendicular orientation relative to the outlet pipe and axially aligning the resonator shell with the outlet pipe.

19. The method according to claim 16 including the step of installing a noise attenuation valve assembly in one of the outlet pipe and bypass pipe.

20. The method according to claim 16 including the steps of stamping a horizontal baffle to form the first muffler component, and mounting the horizontal baffle within the muffler outer shell.

21. The method according to claim 20 including the steps of mounting a noise attenuation valve assembly within the horizontal baffle, positioning an inlet pipe in a first cavity formed on one side of the horizontal baffle, and positioning the outlet pipe in a second cavity formed on an opposite side of the horizontal baffle such that exhaust gases flow from the first cavity through the noise attenuation valve and into the second cavity.

22. The method according to claim 15 including forming the bypass pipe mount with a first portion that extends obliquely relative to a centerline of the outlet pipe and a second portion that extends parallel relative to the centerline of the outlet pipe, with the bypass pipe to be received within the second portion.

23. The method according to claim 15 including forming the resonator by wrapping a resonator material around a resonator pipe to form a resonator sub-assembly, and positioning the resonator sub-assembly within the internal cavity defined between the first and second resonator shell portions such that the resonator is formed when the first and second muffler components are attached to each other.

24. The method according to claim 15 wherein the resonator and outlet pipe are coaxial.

25. The method according to claim 15 wherein the internal cavity is defined by inwardly facing surfaces of the first and the second muffler components, and including installing resonator material within the resonator shell to be in abutting contact with the inwardly facing surfaces.

* * * * *